US007661938B2

(12) United States Patent
Ginies et al.

(10) Patent No.: US 7,661,938 B2
(45) Date of Patent: Feb. 16, 2010

(54) LINKING ELEMENT FOR CONNECTING THE TWO VOLUTES OF A SCROLL COMPRESSOR

(75) Inventors: Pierre Ginies, Sathonay Village (FR); Dominique Gross, Jassans Riottier (FR)

(73) Assignee: Danfoss Commercial Compressors, Trevoux (FR)

( * ) Notice: Subject to any disclaimer, the term of this patent is extended or adjusted under 35 U.S.C. 154(b) by 169 days.

(21) Appl. No.: 11/918,744

(22) PCT Filed: May 9, 2006

(86) PCT No.: PCT/FR2006/001027

§ 371 (c)(1),
(2), (4) Date: Dec. 17, 2007

(87) PCT Pub. No.: WO2006/125879

PCT Pub. Date: Nov. 30, 2006

(65) Prior Publication Data

US 2009/0047161 A1 Feb. 19, 2009

(30) Foreign Application Priority Data

May 23, 2005 (FR) ..... 05 05151

(51) Int. Cl.
*F04C 18/02* (2006.01)
*F01C 1/02* (2006.01)
*F04C 29/00* (2006.01)

(52) U.S. Cl. ..... 418/179; 418/55.1; 418/55.3

(58) Field of Classification Search ..... 418/55.3, 418/55.1, 179; 384/279, 902
See application file for complete search history.

(56) References Cited

U.S. PATENT DOCUMENTS

| | | | | |
|---|---|---|---|---|
| 5,275,543 | A * | 1/1994 | Tanaka et al. | 418/55.3 |
| 6,106,252 | A | 8/2000 | Yamanaka et al. | |
| 6,261,072 | B1 * | 7/2001 | Abe et al. | 418/55.3 |
| 6,299,424 | B1 | 10/2001 | Futagami et al. | |

FOREIGN PATENT DOCUMENTS

| | | | |
|---|---|---|---|
| JP | A 62-298680 | | 12/1987 |
| JP | 02067481 | A * | 3/1990 |
| JP | 02176177 | A * | 7/1990 |
| JP | 02283882 | A * | 11/1990 |
| JP | 04330391 | A * | 11/1992 |

(Continued)

*Primary Examiner*—Thomas E Denion
*Assistant Examiner*—Mary A Davis
(74) *Attorney, Agent, or Firm*—Oliff & Berridge, PLC

(57) ABSTRACT

The invention concerns an element comprising an annular body (9) provided with two series of pins (10, 12) projecting from at least one side of the body (9), the pins (10) of a first series being engaged in grooves (7) of the fixed volute (3) and the pins (12) of a second series being engaged in grooves (8) of the mobile volute (4), to provide an orbital movement of the mobile volute (4) relative to the fixed volute (3), the contact surfaces of the pins (10, 12) of a common series with the walls of the grooves of the corresponding volute being parallel and the contact surfaces of the pins (10, 12) belonging to two series of pins being perpendicular. The annular body (9) is made of a first metal with a specific density and the pins are made of a second metal having a lower density than that of the first metal.

9 Claims, 6 Drawing Sheets

FOREIGN PATENT DOCUMENTS

| | | | |
|---|---|---|---|
| JP | A 04-330392 | | 11/1992 |
| JP | A 05-231348 | | 9/1993 |
| JP | 07259755 | A * | 10/1995 |
| JP | A 2000-283063 | | 10/2000 |
| JP | A 2004-308591 | | 11/2004 |

* cited by examiner

LINKING ELEMENT FOR CONNECTING THE TWO VOLUTES OF A SCROLL COMPRESSOR

The present invention relates to a linking element for connecting the two volutes of a scroll compressor.

A scroll compressor comprises a jacket separated by a compression stage into two compartments, namely a low-pressure compartment into which the refrigerant gas is admitted, and a high-pressure compressed gas compartment. The compression stage has two scroll elements or volutes that fit inside one another, a fixed volute which is situated on the high-pressure compartment side, and a moving volute which is situated on the low-pressure compartment or gas suction compartment side. The two volutes define pockets in which the gas is compressed. The moving volute is caused to move in an orbital manner which progressively reduces the volume of the pockets, thereby compressing the gas. The gas is admitted into the pockets, from the low-pressure compartment, to the exterior of the volutes. The gas passes through at least one orifice into the pockets defined by the scrolls of the volutes, and is carried by the pockets into the center of the compression stage, from where it passes out through a central orifice, into the high-pressure compartment.

The low-pressure compartment contains an electric motor whose stator is fixed relative to the compressor jacket, and whose rotor carries a shaft, one end of which forms a crank and is engaged in a central cavity in the moving volute. In order to achieve orbital movement of the moving volute relative to the fixed volute, a linking and guiding element, also known as an Oldham joint, is provided. This linking element comprises, as in the prior art, an annular body having two series of pegs projecting from at least one side of the body, the pegs of a first series being engaged in slots in the fixed volute and the pegs of a second series being engaged in slots in the moving volute, to ensure orbital movement of the moving volute with respect to the fixed volute, those faces of the pegs of any one series which contact the walls of the slots of the corresponding volute being parallel, and those contact faces of the pegs belonging to two series of pegs being perpendicular. Depending on the configuration of the fixed and moving volutes, the two series of pegs may either project on both sides of the annular body, or both project on the same side of the annular body.

In the prior art, the annular body has usually a rectangular section, or H profile, with the openings formed by the arms of the H directed, one toward the fixed volute and the other toward the moving volute.

As a rule, in the prior art, the body of the connecting element and the pegs are a single piece of die cast aluminum or a single piece of sintered metal. The problem with this solution is that the linking element lacks stiffness, particularly in the case of large machines.

It is also known practice to make the annular body and pegs in the form of a single piece of steel, with the drawback that the weight is too great in the case of large machines.

The technical problem to be solved is therefore to provide a linking element having good stiffness and reasonable weight and that prevents seizure between the pegs on the one hand, and the slots relative to which they move on the other.

To this end, the invention relates to the linking element of the abovementioned type, in which the annular body is made of a first metal of a given density and the pegs are made of a lightweight second metal less dense than the first metal.

In a preferred embodiment of the invention, the annular body is made of steel.

The pegs are advantageously made of aluminum, an aluminum-based alloy, or sintered metal.

In one embodiment of this linking element, the pegs of lightweight metal or sintered metal are overmolded onto the steel body.

Once it has been made, the annular body is placed in a mold in which it is overmolded with a lightweight metal, such as aluminum or an aluminum-based alloy. If the pegs are sintered metal, the sintering—i.e. the agglomeration of the metallic particles—can be performed directly on the annular body. Another possible way is to make the lightweight metal pegs in two parts and fix them together by, for example, bolting them around the annular body.

The steel body is advantageously of tubular cross section.

The use of steel for the body of the element allows the wall to be made thin while still having excellent stiffness, owing to the fact that the body takes the form of a profile, such as a tubular-sectioned profile. The use of pegs made of a lightweight metal such as aluminum, or an aluminum alloy, means that there is less risk of seizure between the pegs and the walls defining the slots in the fixed volute and in the moving volute.

As an example, a body of an element according to the invention made out of 12 mm steel tube with a wall thickness of 1.35 mm weighs the same as aluminum H profile 12 mm wide, and 10 mm high, with a height of the small arms of 2 mm. However, the stiffness of the steel tubular profile is 43% greater than that of the die cast aluminum H profile.

It is therefore possible to make large linking elements that weigh less than in the prior art, or, for the same weight, are much stiffer.

In one embodiment of this linking element, the steel body is a profile that comprises, viewed in transverse section, a cavity opening in the plane of the ring formed by the body.

Each peg advantageously is of generally parallelepiped shape and has rounded edges designed to come into contact with the walls of the volute slot in which the peg in question is guided.

Sliding feet are advantageously arranged opposite the pegs to stabilize the movement of the linking element in its plane so that the faces of the pegs are made more nearly parallel in the slots and thus improve the reliability.

In one possible version, the edges of the two faces of each peg are rounded, the radius of curvature of a face that does not press against the wall of a slot being greater than the radius of a face which does bear against the wall of a slot.

The presence of these rounded edges reduces the contact pressure and so limits the risk of seizure, which means the body can be made less stiff. It may be pointed out that sliding feet can be provided in the walls of the slots coming into contact with the pegs of the linking element.

The invention will be explained clearly with the aid of the following description, which refers to the appended schematic drawing showing, by way of non-restricted example, two embodiments of this linking element.

FIG. 1 shows a linking element denoted by the general reference 2, designed to be mounted between a fixed volute 3 and a moving volute 4 of a scroll compressor. As shown in the drawing, the fixed volute 3 comprises a scroll 5, while the moving volute 4 comprises an opposing scroll 11. The respective scrolls 5, 11 of the fixed volute 3 and moving volute 4 are designed to fit inside each other. The moving volute 4 has, on its opposite face to that comprising a scroll, a sleeve 6 in which a crank of a drive shaft can engage. The fixed volute 3 has two slots 7 extending on from one another or having their axes parallel, while the volute 4 has two slots 8 extending on from one another or having their axes parallel.

Figure 1:
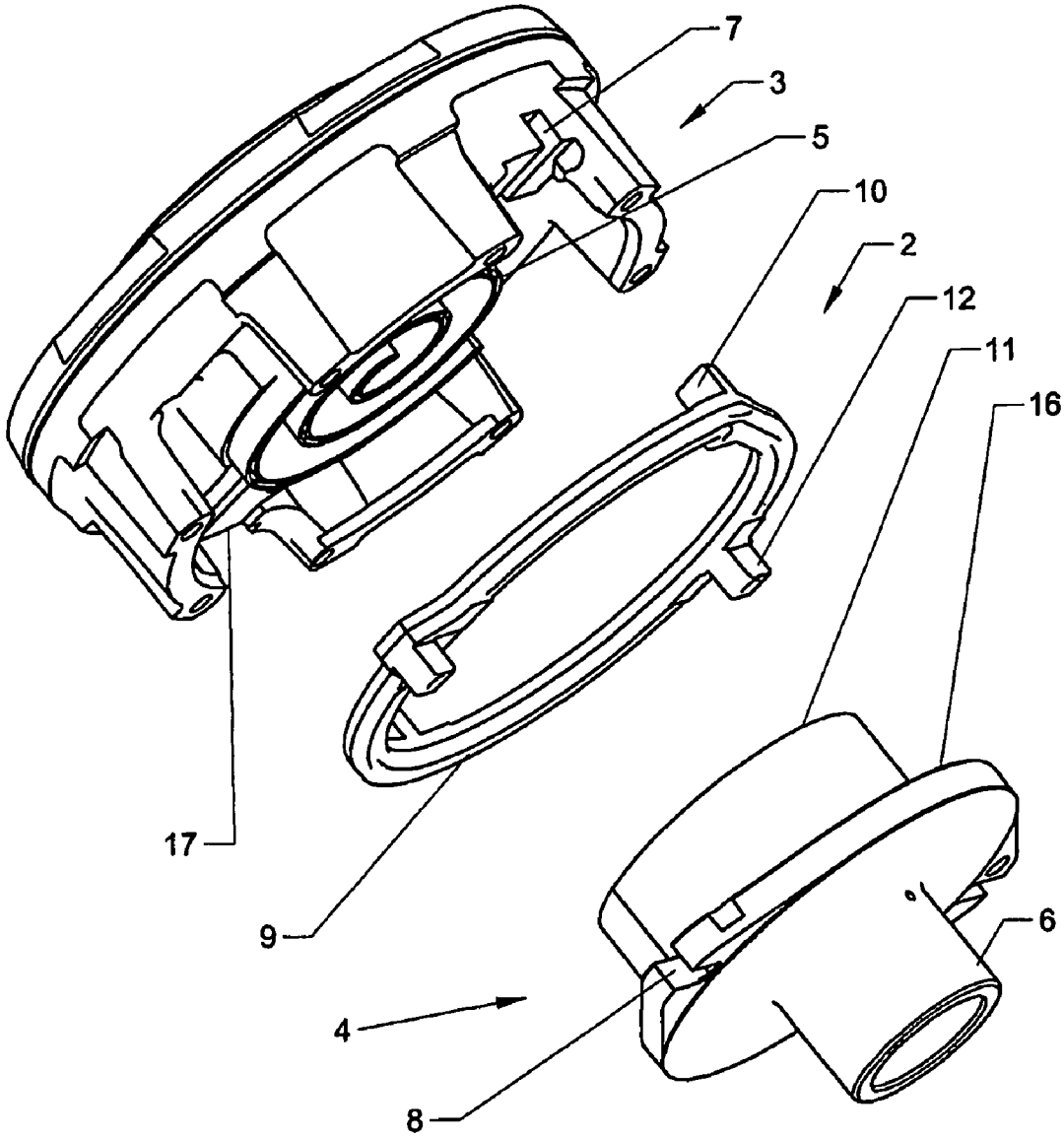
FIG. 1 is an exploded perspective view of a first linking element placed between a fixed volute and a moving volute of a compressor.
Figure 2:
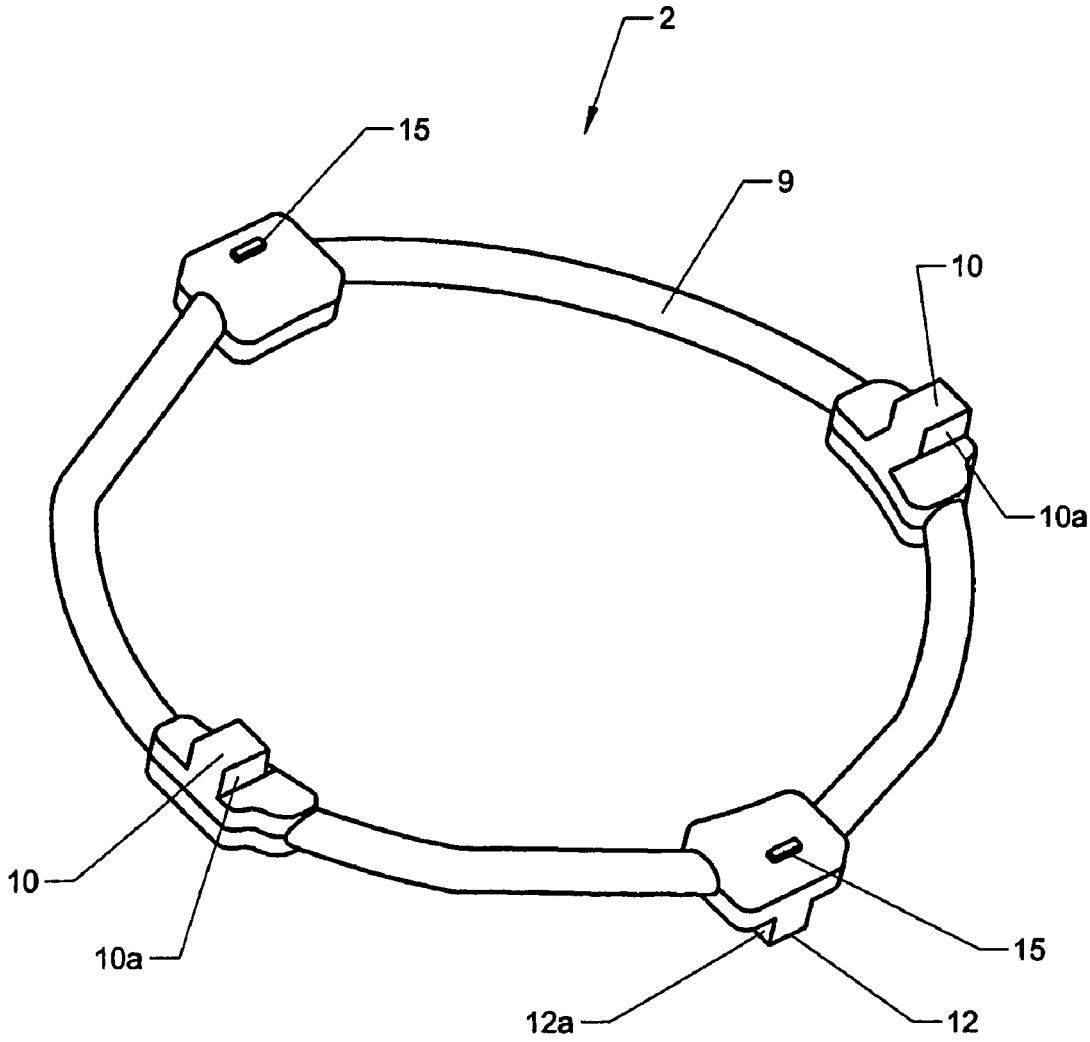
FIG. 2 is a perspective view of this linking element.
Figure 3:
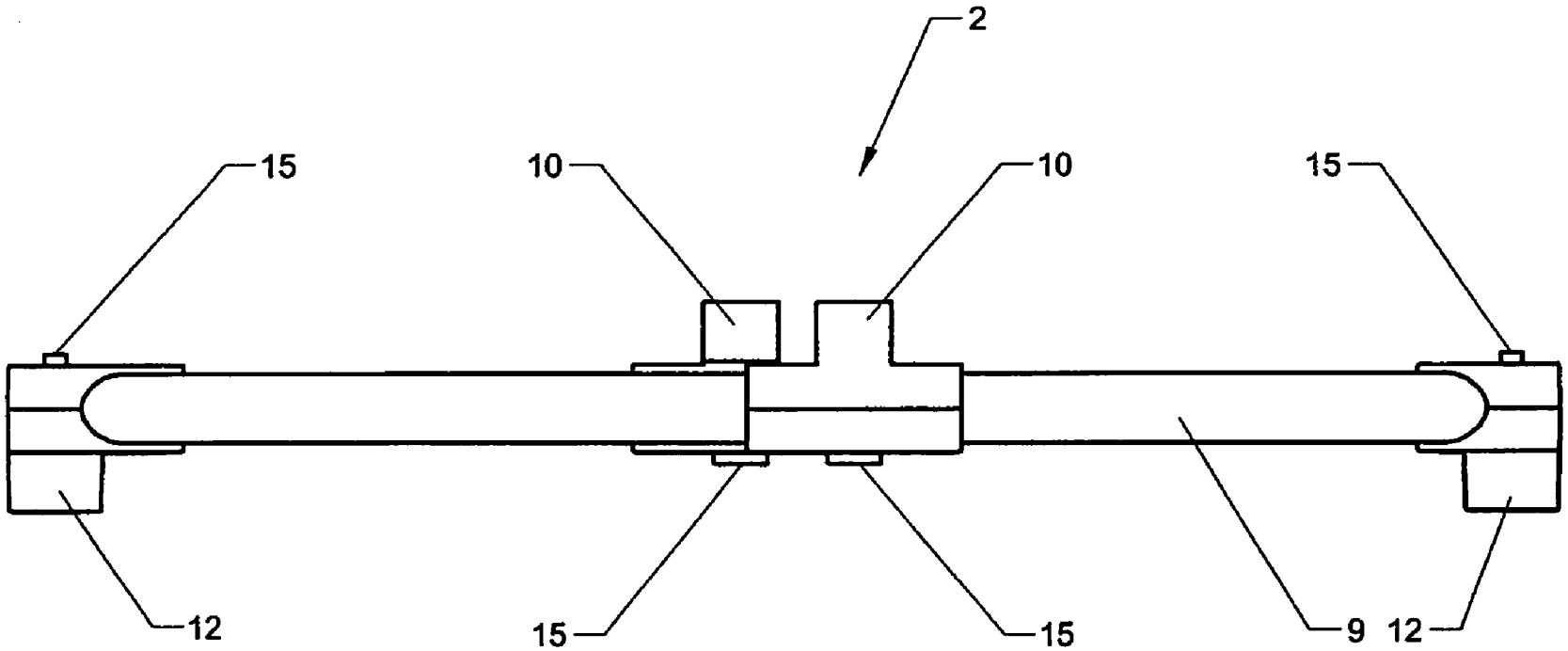
FIG. 3 is a front view.

The linking element 2 for connecting the two volutes 3 and 4 comprises a body 9 of circular shape consisting of a steel tube closed on itself. Fixed to this tube, by overmolding for example, are two series 10 and 12 of pegs. The pegs 10, 12 could also be made independently, each in one or more parts, and be fixed to the annular body by threaded fasteners, for example. The two series 10 and 12 of pegs are arranged so that the contact faces 10*a* or 12*a* of the pegs 10 or 12 of one series are parallel and the contact faces 10*a* or 12*a* of the pegs 10 and 12 of the two series are perpendicular. The two pegs 10 of the first series project from the body 9 toward the fixed volute 3, while the two pegs 12 of the second series project from the other side of the body 9, toward the moving volute 4. The pegs 10 are designed to be engaged in the slots 7 of the fixed volute 3, while the pegs 12 are designed to be engaged in the slots 8 of the moving volute 4. Thus, when the end of the drive crank describes a circle while engaged in the sleeve 6 of the moving volute, the moving volute describes an orbital movement but cannot pivot, because of the fact that the pegs 10, 12 are sliding in the slots 7, 8, respectively.

Figure 4:
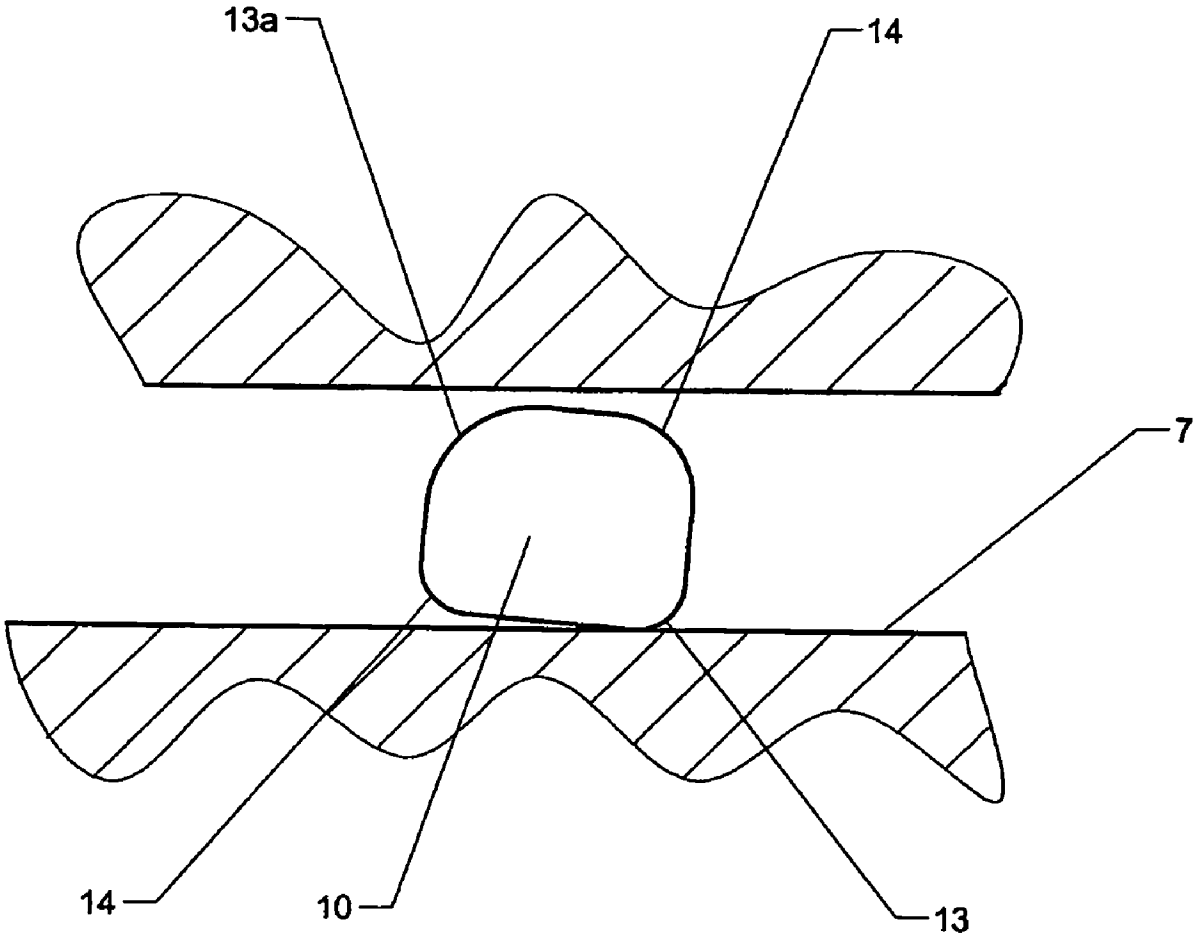
FIG. 4 is a partial cross section through a peg placed in a slot of a volute.

As shown in the drawing, the pegs 10 and 12 are of roughly parallelepiped shape. FIG. 4 shows a detail of a peg 10 engaged in a slot 7 in the fixed volute. However, this same description could apply to a peg 12 engaged in a slot 8 on the moving volute 4. During the orbital movement, the peg tends to push against the walls of the slot 7 through two of its edges. In order to reduce the risk of sticking and jamming, the two edges 13 which push against the walls of the slot are rounded. The radius of curvature of the edge 13*a* on the non-pushing face of the peg, when the compressor is running in its normal direction of rotation, is longer than the radius of curvature of the edge 13 on the pushing face. This rounding is especially useful to avoid the risk of seizure when running the compressor in reverse, or when running it without load. Reducing the risk of seizure in this way makes it possible to reduce the stiffness necessary for the body 9, and so reduce the amount of material used to make the body. The other, non-load bearing edges 14 of the peg could also be rounded.

Feet 15 are provided on the opposite face of the pegs from that engaged in a slot in order to stabilize the movement of the mechanical guiding element in its plane. Specifically, each foot 15 of a peg 10 bears on a base plate 16 of the moving volute 4 containing two slots 8 designed to take the two pegs 12. For its part, each foot 15 of a peg 12 bears on a base plate 17 of the fixed volute 3 in which two slots 7 are formed to take the two pegs 10.

Figure 5:
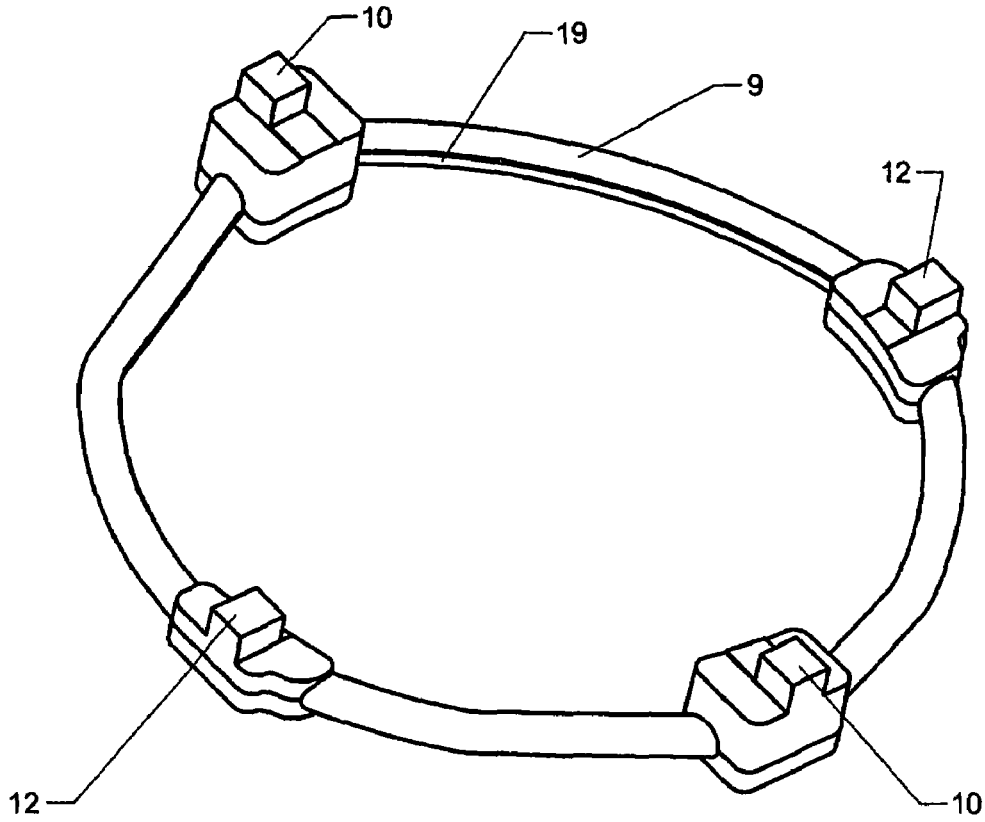
FIG. 5 is a perspective view of a second linking element.
Figure 6:
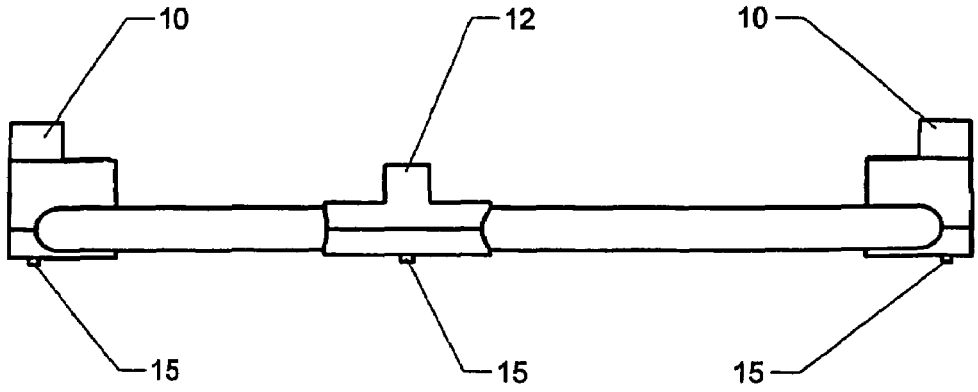
FIG. 6 is a front view of the second linking element.

FIGS. 5 and 6 show another linking element, first in perspective and then in a front view. In this linking element, identical parts are indicated by the same references as before.

In this embodiment, the annular body 9 takes the form of a profile, e.g. of steel, that comprises, viewed in transverse section, a cavity 19 opening in the plane of the ring or at right angles to it.

This linking element also differs from the previous linking element in that the pegs 10, 12 project from the same side of the annular body 9, though the pegs 12 are lower than the pegs 10. This arrangement results from a corresponding structure of the fixed and moving volutes, which are not shown in the drawing.

Figure 7:
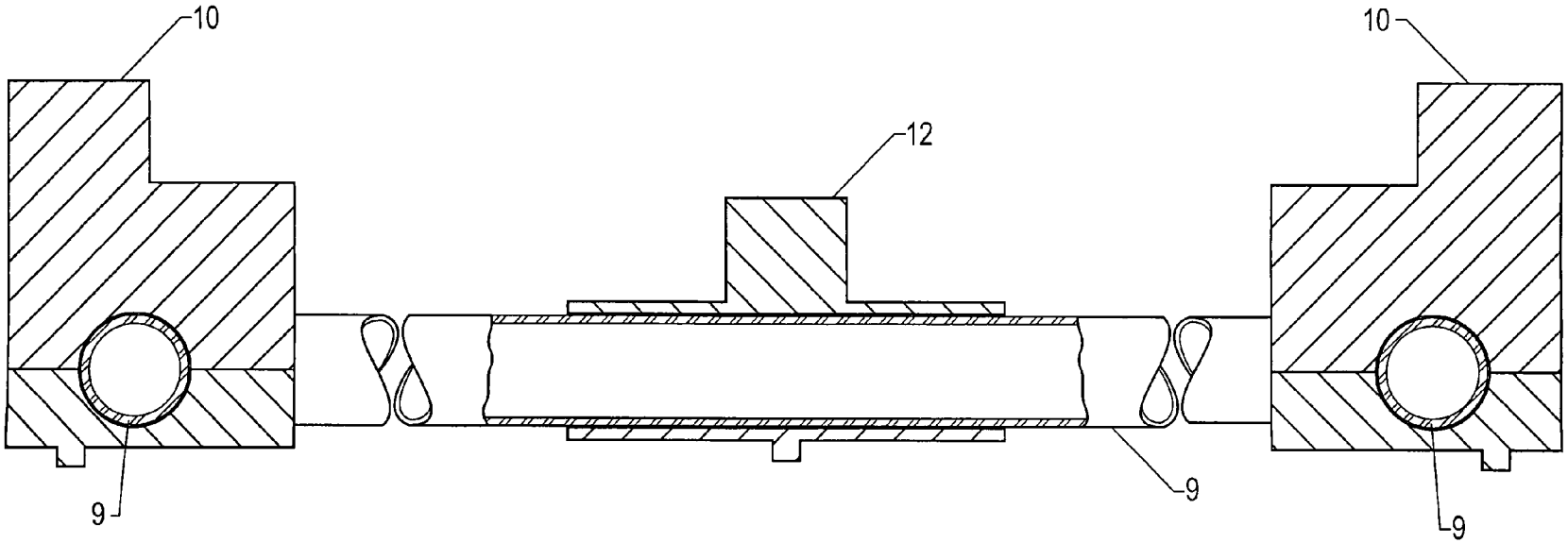
FIG. 7 is another front view of the second linking element.

As illustrated in FIG. 7, Body 9 is made of a first metal while pegs 10 and 12 are made from a second metal. The first metal can be, for example, steel. The second metal is less dense than the first metal and can be, for example, aluminum, an aluminum-based alloy, or a sintered metal.

As will be clear from the above, the invention represents a great improvement on the prior art, providing a linking element for connecting the two volutes of a scroll compressor that gives the body excellent stiffness while limiting the weight of the element.

It goes without saying that the invention is not limited to the single embodiment of this linking element which has been described with a tubular body. On the contrary, it encompasses all alternative embodiments.

The invention claimed is:

1. A linking element between the two volutes of a scroll compressor, of the type comprising an annular body having two series of pegs projecting from at least one side of the annular body, the pegs of a first series being engaged in slots in the fixed volute and the pegs of a second series being engaged in slots in the moving volute, to ensure orbital movement of the moving volute with respect to the fixed volute, those faces of the pegs of any one series which contact the walls of the slots of the corresponding volute being parallel, and the contact faces of the pegs of the first series are perpendicular to the contact faces of the pegs of the second series, said linking element being characterized in that the annular body is made of a first metal of a given density and the pegs of the first and second series are made of a second metal less dense than the first metal.

2. The linking element as claimed in claim 1, wherein the annular body is made of steel.

3. The linking element as claimed in claim 1, wherein the pegs of the first and second series are made of aluminum or an aluminum based alloy.

4. The linking element as claimed in claim 1, wherein the pegs of the first and second series are made of sintered metal attached to the annular body.

5. The linking element as claimed in claim 1, wherein the pegs of the first and second series are overmolded onto the annular body.

6. The linking element as claimed in claim 1, wherein the annular body is of tubular cross section.

7. The linking element as claimed in claim 1, wherein the annular body is a profile that comprises, viewed in transverse section, a cavity opening in the plane of the ring or at right angles to it.

8. The linking element as claimed in claim 1, wherein each peg of the first and second series is of generally parallelepipedal shape and has rounded edges designed to come into contact with the walls of the volute slot in which the peg of the first and second series in question is guided.

9. The linking element as claimed in claim 8, wherein the edges of the two faces of each peg of the first and second series are rounded, the radius of curvature of a face that does not press against a wall of the slot of one of the two volutes being greater than the radius of a face which does bear against the wall of a slot.

* * * * *